US012123673B1

(12) United States Patent
Hillis et al.

(10) Patent No.: US 12,123,673 B1
(45) Date of Patent: Oct. 22, 2024

(54) HYBRID CHARGING HANDLE FOR A FIREARM

(71) Applicant: DFM Arms, LLC, Sheridan, WY (US)

(72) Inventors: Mark Hillis, Manchester, TN (US); Nathan Dudney, Nashville, TN (US); Evan Dungan, Christiana, TN (US); Joel Stanley, Smyrna, TN (US)

(73) Assignee: DFM Arms, LLC, Sheridan, WY (US)

( * ) Notice: Subject to any disclaimer, the term of this patent is extended or adjusted under 35 U.S.C. 154(b) by 0 days.

(21) Appl. No.: 18/499,993

(22) Filed: Nov. 1, 2023

Related U.S. Application Data

(63) Continuation of application No. 17/847,726, filed on Jun. 23, 2022, now Pat. No. 11,965,706.

(60) Provisional application No. 63/215,323, filed on Jun. 25, 2021, provisional application No. 63/421,618, filed on Nov. 2, 2022.

(51) Int. Cl.
*F41A 3/72* (2006.01)

(52) U.S. Cl.
CPC ..... *F41A 3/72* (2013.01)

(58) Field of Classification Search
CPC ..... F41A 3/72
See application file for complete search history.

(56) References Cited

U.S. PATENT DOCUMENTS 10,161,697 B1 * 12/2018 Underwood ..... F41A 3/72
11,965,706 B2 * 4/2024 Hillis ..... F41A 3/72

* cited by examiner

*Primary Examiner* — Reginald S Tillman, Jr.
(74) *Attorney, Agent, or Firm* — J. Kenneth Hoffmeister

(57) ABSTRACT

A hybrid charging handle for a firearm. The hybrid charging handle includes a plastic shell attached to a metal skeleton. The metal skeleton is stamped and folded to provide strength and rigidity. The plastic shell is molded to provide the geometry fitting the firearm. The plastic shell is attached to the metal skeleton to form the hybrid charging handle. The plastic shell provides benefits such a low friction. The hybrid charging handle can be manufactured cheaper and faster than conventional charging handles and with less material waste.

20 Claims, 3 Drawing Sheets

HYBRID CHARGING HANDLE FOR A FIREARM

BACKGROUND

A charging handle on a firearm pulls the bolt rearward and places the striker into a cocked position facilitating the ejection and reloading of rounds into the chamber, the verification of whether the chamber is loaded, the clearing of jams, and similar activities. Durability is a significant issue in the design of a charging handle. The movement of the charging handle against other parts in the upper receiver creates wear and can lead to fatigue and breakage. Conventional charging handles are built from durable metals that are easy to work with, such as aluminum. However, metal charging handles tend to suffer from poor ergonomics. Some recent advances in the art have attempted to cushion the grip of the charging handle to make it more ergonomic. Moreover, the metal charging handles tend to be noisy. The movement of a metal charging handle against the metal parts of the upper receiver creates undesirable noise in tactical and hunting situations. The noise is further exacerbated by part wear and poor fitment causing rattling even when the charging handle not actively being used. Despite the apparent simplicity, charging handles are relatively intricate in design and require lots of costly millwork making it an expensive and time-consuming part to manufacture and creating significant amounts of waste. It is with respect to these and other considerations that the present invention has been made.

BRIEF DESCRIPTION OF THE DRAWINGS

Further features, aspects, and advantages of the present disclosure will become better understood by reference to the following figures wherein like reference numbers indicate like elements throughout the several views.

BRIEF SUMMARY

Figure 1:
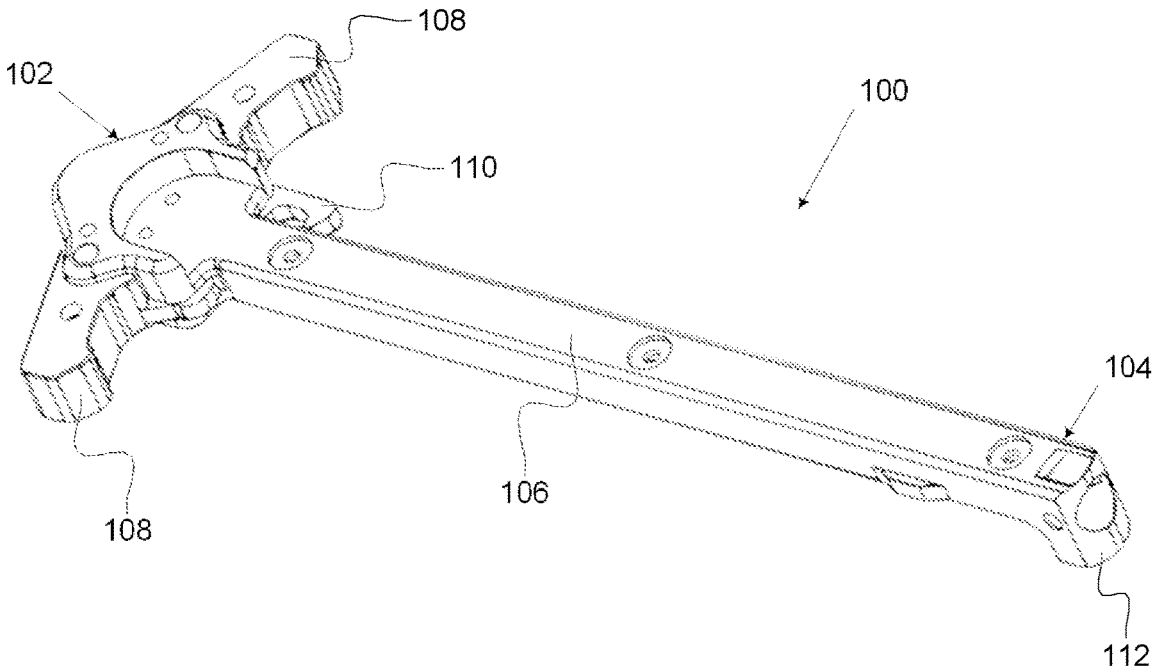
FIG. 1 is front perspective view of an embodiment of a hybrid charging handle.

The following summary discusses various aspects of the invention described more fully in the detailed description and claimed herein. It is not intended to be limiting and should not be used to limit the claimed invention to only such aspects or to require the invention to include all such aspects.

A hybrid charging handle for a firearm is an elongated member having a grip end and a hook end at opposing ends of a shaft. The grip end includes one or more grips that are pivotally attached to the hybrid charging handle. Pulling on the grips releases a latch that is configured to engage the upper receiver of a firearm and hold the hybrid charging handle in place. The hook end includes a downwardly extending projection that is designed to operatively engage the bolt of the firearm allowing it to be retracted when the grip end is pulled rearward.

Generally, the hybrid charging handle has an exterior shell fabricated from a plastic and an internal skeleton fabricated from a metal. In various embodiments, the shell is overmolded on the skeleton. In other embodiments, the shell is a molded part that is secured to the skeleton via mechanical fasteners, an adhesive fastener, or other suitable fasteners. In various embodiments, the shell completely or mostly covers the skeleton to limit the amount of metal exposed by the hybrid charging handle.

The skeleton provides the primary structural support and strength for the hybrid charging handle. The skeleton is an elongated member having a head and a foot at opposing ends of a spine. The spine is fabricated from a metal or other rigid material. The spine has a central portion with two longitudinal walls that are substantially perpendicular to the central portion to give the spine a substantially "C"-shaped cross section. The "C"-shape of the spine adds rigidity to the hybrid charging handle. The ends of the longitudinal walls proximate to the foot are extended to form claws for gripping the bolt of the upper receiver. The grips and the back plate may also be formed of a metal or other rigid material.

The grips are sandwiched between the skeleton and the back plate and pivotally attached to allow them to rotate and disengage the latch when pulled. The head, the grips, and the back plate may define a plurality of optional through openings. These through openings have various functions based on the design of the hybrid charging handle including, without limitation, receiving pins or molded extensions that pivotally attach the grips to the hybrid charging handle, aligning the skeleton with the base plate, receiving pins or molded extensions to form stops that limit movement of the grips, reducing weight, or providing attachment points for components of the hybrid charging handle.

By covering the skeleton with a plastic, the hybrid charging handle provides reduced wear compared to conventional charging handles. In general, most plastics will have friction characteristics that meet or exceed those obtained with an anodized aluminum found in conventional charging handles. Various embodiments utilize a lubricated or low-friction plastic with a low wear rate to allow the hybrid charging handle to easily move within the upper receiver and reduce wear. Aspects of the invention include enhancing the base plastic characteristics through additives. However, simply using a plastic shell, without regard to any special properties of the plastic, provides advantages over conventional metal charging handles.

Because the plastic shell of the hybrid charging handle encounters less friction when moving within the upper receiver, it is possible to design the outer dimensions of the hybrid charging handle with tighter tolerances relative to the upper receiver. A tighter fit means less room for the hybrid charging handle to bow. The higher rigidity steel skeleton better resists the forces applied by the recoil spring and is less likely to bow. The plastic shell of the hybrid charging handle offers noise reduction. Finally, the hybrid charging handle is faster and cheaper to fabricate with less material waste.

DETAILED DESCRIPTION

Aspects of a hybrid firearm charging handle are described herein and illustrated in the accompanying figures. The hybrid charging handle includes a plastic shell attached to a metal skeleton. The metal skeleton is stamped and folded to provide strength and rigidity. The plastic shell is molded to provide the geometry fitting the firearm. The plastic shell is attached to the metal skeleton to form the hybrid charging handle. The plastic shell provides benefits such a low friction. The hybrid charging handle can be manufactured cheaper and faster than conventional charging handles and with less material waste.

For convenience, generic references to the materials used in the construction of the hybrid magazine may be used. Such references are not intended to be limiting. Specifically, the term "plastic" is intended to encompass to any moldable material having a polymeric base including thermoset plastics, thermoplastics, and plastic composites (e.g., a glass filled nylon).

FIG. 1 is a front perspective view of an embodiment of a hybrid charging handle illustrating aspects of the present invention. The operation of a charging handle 100 is deemed to be understood by those of ordinary skill in the art. The illustrated hybrid charging handle 100 is an embodiment of a non-reciprocating charging handle used in AR style rifles and related firearms. However, the present invention is intended to encompass charging handles for other firearms and should not be limited to any particular firearm.

The hybrid charging handle 100 is an elongated member having a grip end 102 and a hook end 104 at opposing ends of a shaft 106. In the illustrated embodiment, the grip end 102 includes two grips 108 that are pivotally attached to the hybrid charging handle 100. Pulling on the grips 108 releases a latch 110 that is configured to engage the upper receiver of a firearm and hold the hybrid charging handle 100 in place. In alternative embodiments, the grip end utilizes a simpler design with fixed extensions forming the "T"-shape and with an attached spring mechanism that engages the upper receiver. In an alternative embodiment with one grip fixedly attached and the other grip is pivotally attached, the latch is associated with the pivotally attached grip. Other variations of the grip end that operatively engage the upper receiver are deemed to fall within the scope and spirit of the present invention. The hook end 104 includes a downwardly extending projection 112 that is designed to operatively engage the bolt of the firearm allowing it to be retracted when the grip end 102 is pulled rearward.

Figure 2:
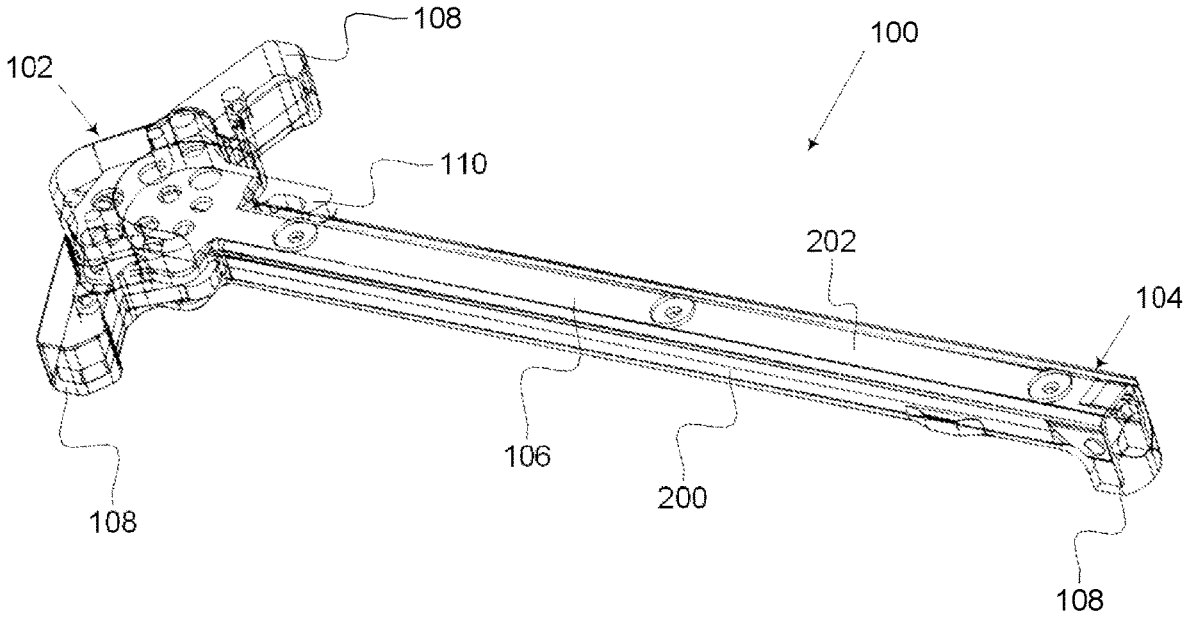
FIG. 2 is a front elevation view of an embodiment of the hybrid charging handle with the selected components, including the plastic shell, illustrated in phantom.

FIG. 2 is an alternate view of an embodiment of a charging handle with the exterior illustrated in phantom. In the illustrated embodiment, the hybrid charging handle 100 has an exterior shell 200 fabricated from a plastic and an internal skeleton 202 fabricated from a metal. In various embodiments, the metal is a steel or aluminum. Aspects of the present invention include securing the shell 200 to the skeleton 202 by various methods. In various embodiments, the shell 200 is overmolded on the skeleton 202. In other embodiments, the shell 200 is a molded part that is secured to the skeleton via mechanical fasteners, an adhesive fastener, or other suitable fasteners. In various embodiments, the shell 200 completely or mostly covers the skeleton 202 to limit the amount of metal exposed by the hybrid charging handle 100.

Figure 3:
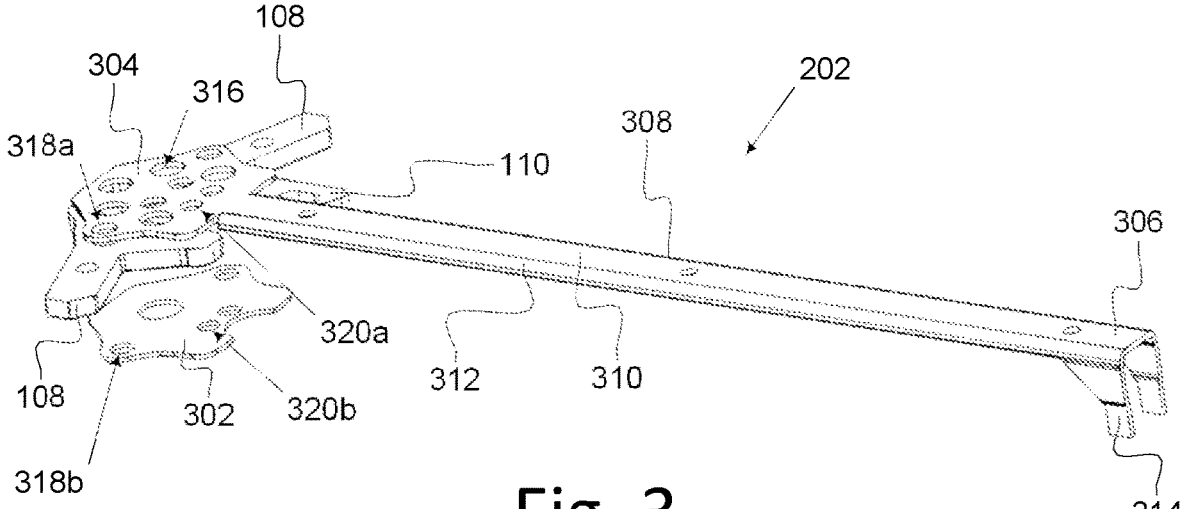
FIG. 3 is a front elevation view of an embodiment of the skeleton and related components of the hybrid charging handle.
Figure 4:
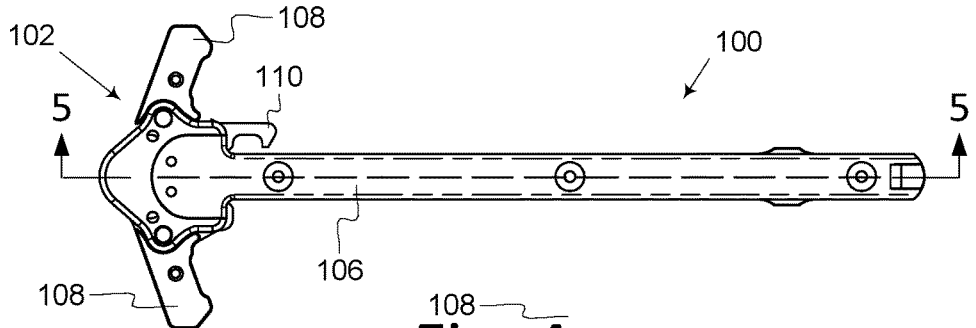
FIG. 4 is a top plan view of the hybrid charging handle of FIG. 1.
Figure 5:
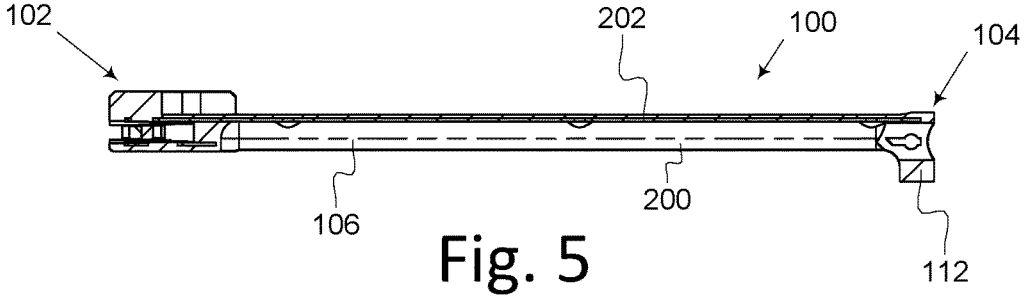
FIG. 5 is a sectional side elevation view of the hybrid charging handle taken along section 5-5.
Figure 6:
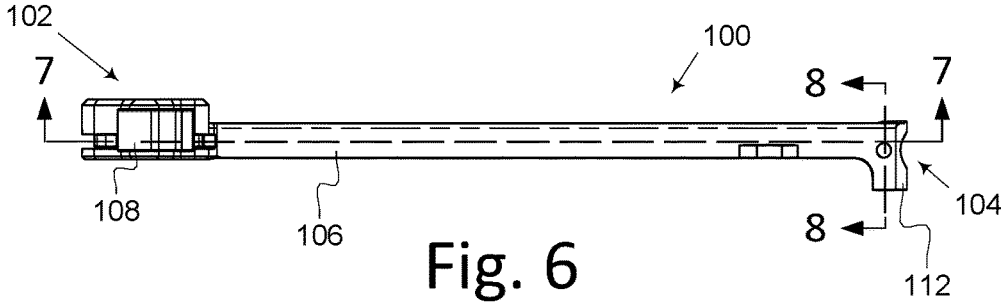
FIG. 6 is a side elevation view of the hybrid charging handle of FIG. 1.
Figure 7:
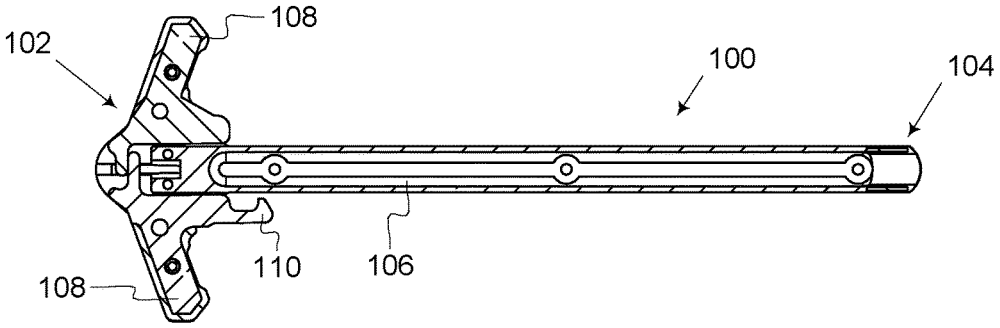
FIG. 7 is a sectional top plan view of the hybrid charging handle, taken along section 7-7.
Figure 8:
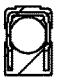
FIG. 8 is a sectional front elevation view of hook end of the hybrid charging handle, taken along section 8-8.

FIG. 3 is a front perspective view of selected components of the hybrid charging handle illustrating aspects of an embodiment of the present invention. Illustrated in FIG. 3 are the skeleton 202, the grips 108, and a back plate 302.

The skeleton 202 provides the primary structural support and strength for the hybrid charging handle 100. The skeleton 202 is an elongated member having a head 304 and a foot 306 at opposing ends of a spine 308. The spine 308 has a central portion 310 with two longitudinal walls 312 that are substantially perpendicular to the central portion 310 to give the spine 308 a substantially "C"-shaped cross section. In various embodiments, such an arrangement is accomplished by stamping the skeleton 202 and positioning the longitudinal walls 310 in a subsequent folding operation. The "C"-shape of the spine 308 adds rigidity to the hybrid charging handle 100. In various embodiment, the "C"-shape serves other functions such as providing a mechanism for guiding movement of the hybrid charging handle 100 along a rail in the upper receiver of the firearm.

The ends of the longitudinal walls 310 proximate to the foot 306 are extended to form claws 314 for gripping the bolt of the upper receiver. The claws 314 are generally shaped to engage the upper receiver. Aspects of present invention include incorporating the claws 314 into the longitudinal side walls such that the forces applied to the bolt are carried by the structure of the longitudinal side walls. In an alternative aspect, the claws 314 are supplemented by a tab at the end of the foot 306 that is folded down to form an L-shape with the spine 308. In other words, the tab is orthogonal to the longitudinal walls 310 and the claws 314.

In the illustrated embodiment, the claws 314 are formed by shaping the sheet metal with a generally "T"-shaped foot. The extensions of the "T" extend outward past the profile of the longitudinal walls 310. Aspects of the present invention include giving the claw 314 a larger width at the top proximate to the spine 308 and tapering towards in the direction of the foot 306 to a minimum width for the claw 314 at a position approximately midway along the height of the claw 314. The bottom portion of the claw 314 has a substantially rectangular shape configured to engage the bolt of the upper receiver. The shape and relative dimensions in the illustrated embodiment are exemplary and may vary to accommodate various firearms or based on other design considerations without departing from the scope and spirit of the present invention. While it is not necessary to provide extra width at the top of the claw 314 and taper down to a size suitable for engaging the upper receiver, the extra width at the top of the claw 314 provides more material to withstand the forces exerted when moving the upper receiver. The design of the claws 314 provides the strength to retract the bolt despite the reduced amount of metal present in the hybrid charging handle 100 when compared to prior art charging handles which are milled from a solid block of metal.

In yet another alternative aspect, the tab is utilized without the claws 314 with the tab being reinforced to prevent the tab bending back toward the plane of the central portion 310 of the spine 308 when pulling against the bolt. Reinforcement can be accomplished by various techniques, such as encasing the tab in a suitable high strength plastic or with additional machining steps, although adding such steps adds to the cost and time required to fabricate the skeleton 202.

The size and shape of the skeleton 202 and any or all of its subcomponents, the grips 108, and the back plate 302 may vary to accommodate different firearm designs. The skeleton 202 optionally includes ancillary features, such as through openings along the central portion 310 of the spine 308 that are used during manufacturing to align the skeleton 202 in the mold during the overmolding process.

The grips 108 are sandwiched between the skeleton 202 and the back plate 302 and pivotally attached to allow them to rotate and disengage the latch 110 when pulled. In the illustrated embodiment, the head 302, the grips 108, and the back plate 302 define a plurality of optional through openings 316. These through openings 316 have various functions based on the design of the hybrid charging handle 100. Corresponding through-openings 318*a-b* in the skeleton 202, the grips 108, and the back plate 302 are aligned to receive pivot pins (not illustrated) that pivotally attach the grips 108 to the hybrid charging handle 100. Other corresponding through openings 320*a-b* are used for various purposes, such as, and without limitation, aligning the skeleton 202 with the base plate 302, adding stops (not illustrated) to the hybrid charging handle 100 that limit movement of the grips 110, reducing weight, and providing additional attachment points for plastic components of the hybrid charging handle 100. Other embodiments of the hybrid charging handle 100 may have designs that vary number, size, arrangement, and other characteristics of the through openings 208 or even obviate the need for through openings 208 without departing from the scope and spirit of the present invention.

The spine 206 is fabricated from a rigid material. In various embodiments, the spine 206 is fabricated from a sheet metal, such as, but not limited to, steel or aluminum. Steel is typically stronger than aluminum and flexes less. Moreover, sheet steel can be shaped by stamping and folding making it a good option for fabricating the skeleton. The grips 108 and the back plate 302 may also be formed of metal. However, as these components bear less of the load carried by the hybrid charging handle 100, they need not be steel and can be formed from aluminum or even a durable plastic (e.g., glass filled nylon).

A conventional charging handle is subject to metal-on-metal wear from contact with the metal upper receiver of the firearm. Conventional charging handles are milled from aluminum blocks because aluminum is a relatively easy metal to mill. However, aluminum is typically softer than the metal (e.g., steel) used in a typical upper receiver. Conventional charging handles tend to bow in response to the forces presented by the recoil spring when retracting the bolt. This makes operation of the hybrid charging handle less than smooth and results in wear and metal fatigue from repeated motions. At a minimum, the wear weakens the conventional charging handle and affects the outer geometry further reducing the smoothness of the hybrid charging handle operation. In more extreme cases, the weakened conventional charging handle is subject to breakage. While steel offers greater strength than aluminum, metals such as aluminum are still suitable for the hybrid charging handle when used with a shell formed from a plastic that augments the strength of the metal or otherwise resists bowing.

By covering the skeleton with a plastic, the hybrid charging handle provides reduced wear compared to conventional charging handles. In general, most plastics will have friction characteristics that meet or exceed those obtained with an anodized aluminum found in conventional charging handles. In various embodiments, the shell is fabricated from a plastic having desirable properties that enhance the operation of the hybrid charging handle. Various embodiments utilize a lubricated or low-friction plastic with a low wear rate to allow the hybrid charging handle to easily move within the upper receiver and reduce wear. Examples of such plastics include, without limitation, acetal, polyimide, nylon, polybutylene terephthalate (PBT), polyetheretherketone (PEEK), polyethylene terephthalate (PET), and ultra-high molecular weight polyethylene (UHMW). Aspects of the invention include enhancing the base plastic characteristics through additives, such as, but not limited to, polytetrafluoroethylene (PTFE) and graphite for reduced friction or adding fillers, such as, without limitation, glass fibers, for increased strength. However, simply using a plastic shell, without regard to any special properties of the plastic, provides advantages over conventional metal charging handles.

The plastic shell of the hybrid charging handle encounters less friction when moving within the upper receiver, it is possible to design the outer dimensions of the hybrid charging handle with tighter tolerances relative to the upper receiver. A tighter fit means less room for the hybrid charging handle to bow. The higher rigidity steel skeleton better resists the forces applied by the recoil spring and is less likely to bow. These aspects of the hybrid charging handle contribute to improved operation compared to conventional charging handles.

The plastic shell of the hybrid charging handle offers noise reduction. First, the plastic-on-metal interface is quieter than the metal-on-metal interface of a conventional charging handle. Further, a tighter fit means less room for the hybrid charging handle to move within the upper receiver which reduces rattling.

Finally, it is faster and cheaper to fabricate. Milling is a time consuming and wasteful process used to fabricate conventional charging handles. The hybrid charging handle can be made 50 times faster than a typical milled aluminum charging handle and at 40% of the cost estimated by a leading manufacturer of AR platform firearms and parts.

Aspects of the present invention include shaping the skeleton using high speed processes, such as stamping and folding. In various embodiments, the skeleton is placed in a mold and the shell is overmolded to form the outer geometry of the hybrid charging handle. This manufacturing process creates a hybrid charging handle with little waste material. Using a plastic shell for the hybrid charging handle reduces or eliminates the need for secondary processes, such as galvanizing, anodizing, or other coating processes to be applied. The elimination of secondary processes contributes to the reduction in manufacturing time and cost. Even when the shell is molded separately and subsequently attached to the skeleton in a separate process step, the faster speed achieved by molding compared to milling still significantly reduces the time and cost to manufacture the hybrid charging handle relative to conventional charging handles.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A hybrid charging handle for a firearm, said hybrid charging handle comprising:

a skeleton fabricated from a metal, said skeleton having a head, a spine, and a foot, said spine having a central portion and two edge portions, said edge portions being substantially perpendicular to said central portion, said skeleton having a projection extending from each said edge portion proximate to said foot, said claws configured to operatively engage a bolt of a firearm;

a shell attached to said skeleton, said shell fabricated from a plastic, said shell being overmolded onto said skeleton, said shell substantially covering said skeleton; and a pair of grips pivotally connected to said skeleton, at least one of said grips including a latch configured to operative engage an upper receiver of a firearm and hold said hybrid charging handle in a secure position until said latch is disengaged.

2. The hybrid charging handle of claim 1 further comprising a back plate, said back plate having a shape substantially similar to said head, said back plate being formed from a rigid material, said back plate being positioned on a side of said pair of grips opposite said skeleton proximate to said head.

3. The hybrid charging handle of claim 2 wherein said back plate defining a plurality of through openings, said head defining a plurality of through openings, and at least one of said grips defining at least one through opening, wherein at least one of said back plate through openings, at least one of said head through openings, and at least one of said grip through openings are aligned to receive a pivot pin operatively connecting said grips to said hybrid charging handle.

4. The hybrid charging handle of claim 2 wherein said back plate is substantially covered by said shell, said shell securing said back plate to said skeleton.

5. The hybrid charging handle of claim 2 wherein said back plate is fabricated from a metal or a plastic.

6. The hybrid charging handle of claim 1 wherein said spine has a substantially "C"-shaped cross-section defined by said central portion and said edge portions.

7. The hybrid charging handle of claim 1 wherein said central portion defines at least one through opening, said through opening configured to position said skeleton in a mold while said shell is overmolded onto said skeleton.

8. The hybrid charging handle of claim 1 wherein said metal is selected from the group consisting of aluminum and steel.

9. The hybrid charging handle of claim 1 wherein said plastic is selected from the group consisting of acetal, polyimide, nylon, polybutylene terephthalate (PBT), polyetheretherketone (PEEK), polyethylene terephthalate (PET), and ultra-high molecular weight polyethylene (UHMW).

10. The hybrid charging handle of claim 1 wherein said plastic includes one or more additives selected from the group consisting of polytetrafluoroethylene (PTFE), graphite, and glass fibers.

11. The hybrid charging handle of claim 1 further comprising at least one latch connected to one of said grips, said latch configured to operatively engage an upper receiver of the firearm in a resting position and to disengage from the upper receiver when said grip is pivoted.

12. A hybrid charging handle for a firearm, said hybrid charging handle comprising:

a skeleton fabricated from a metal, said skeleton having a head, a spine, and a foot, said spine having a central portion and two side portions, said spine having a substantially "C"-shaped cross-section defined by said central portion and said side portions, said skeleton having a projection extending from each said side portion proximate to said foot, said claws configured to operatively engage a bolt of a firearm;

a shell attached to said skeleton, said shell fabricated from a plastic, said shell being attached to said skeleton, said shell substantially covering said skeleton; and a pair of grips connected to said skeleton, at least one of said grips including a latch configured to operative engage an upper receiver of a firearm and hold said hybrid charging handle in a secure position until said latch is disengaged.

13. The hybrid charging handle of claim 12 further comprising a back plate fabricated from a rigid material, said back plate having a shape substantially similar to said head, said back plate being substantially covered by said shell, said back plate being secured to said skeleton by said shell, said black plate being located proximate to said head and offset from skeleton, said pair of grips being secured between said back plate and said skeleton.

14. The hybrid charging handle of claim 12 further comprising at least one latch connected to one of said grips, said latch configured to operatively engage an upper receiver of the firearm in a resting position and to disengage from the upper receiver when said grip is pivoted.

15. The hybrid charging handle of claim 12 wherein said metal is selected from the group consisting of aluminum and steel.

16. The hybrid charging handle of claim 12 wherein said plastic is selected from the group consisting of acetal, polyimide, nylon, polybutylene terephthalate (PBT), polyetheretherketone (PEEK), polyethylene terephthalate (PET), and ultra-high molecular weight polyethylene (UHMW).

17. The hybrid charging handle of claim 12 wherein said plastic includes one or more additives selected from the group consisting of polytetrafluoroethylene (PTFE), graphite, and glass fibers.

18. A hybrid charging handle for a firearm, said hybrid charging handle comprising:

a skeleton fabricated from a metal selected from the group consisting of aluminum and steel, said skeleton having a head, a spine, and a foot, said spine having a central portion and two edge portions, said edge portions being substantially perpendicular to said central portion, said skeleton having a projection extending from each said edge portion proximate to said foot, said claws configured to operatively engage a bolt of a firearm;

a back plate fabricated from a rigid material, said back plate having a shape substantially similar to said head, said black plate being located proximate to said head and offset from skeleton;

a shell attached to said skeleton, said shell fabricated from a plastic, said shell being overmolded onto said skeleton, said shell substantially covering and connecting said skeleton and said back plate; and a pair of grips pivotally connected to said hybrid charging handle in between said skeleton and said back plate, at least one of said grips including a latch configured to operative engage an upper receiver of a firearm and hold said hybrid charging handle in a secure position until said latch is disengaged.

19. The hybrid charging handle of claim 18 wherein said plastic is selected from the group consisting of acetal, polyimide, nylon, polybutylene terephthalate (PBT), polyetheretherketone (PEEK), polyethylene terephthalate (PET), and ultra-high molecular weight polyethylene (UHMW).

20. The hybrid charging handle of claim 18 wherein said plastic includes one or more additives selected from the group consisting of polytetrafluoroethylene (PTFE), graphite, and glass fibers.

* * * * *